United States Patent [19]

Stongwater Murray

[11] Patent Number: 4,987,614

[45] Date of Patent: Jan. 29, 1991

[54] REINFORCED GLOVE FOR INHIBITING RUNS

[76] Inventor: Stongwater Murray, 326 Hewlett Neck Rd., Woodmere, N.Y. 11598

[21] Appl. No.: 511,073

[22] Filed: Apr. 19, 1990

[51] Int. Cl.[5] ..... A41D 19/02

[52] U.S. Cl. ..... 2/163; 2/165

[58] Field of Search ..... 2/165, 169, 159, 163; 112/269.1

[56] References Cited

U.S. PATENT DOCUMENTS

| | | | |
|---|---|---|---|
| 263,067 | 8/1882 | Slayton | 2/169 |
| 450,715 | 4/1891 | Lee | 2/169 |
| 479,285 | 7/1892 | Lee | 2/169 |
| 531,386 | 12/1894 | Raymond | 2/169 |
| 573,447 | 12/1896 | Comrie | 2/169 |
| 815,878 | 3/1906 | Texier | 2/169 |
| 1,625,368 | 4/1927 | Kurz | 2/169 |
| 1,742,117 | 12/1929 | Aaron | 2/165 |
| 1,984,240 | 12/1934 | Steinberger | 2/165 |
| 2,040,989 | 5/1936 | Green | 2/159 |
| 2,044,909 | 6/1936 | Kovar | 2/165 |
| 2,125,673 | 8/1938 | Geissmann | 2/159 |
| 2,433,327 | 12/1947 | Anderson | 2/169 |

*Primary Examiner*—Werner H. Schroeder

*Assistant Examiner*—Amy Vanatta

*Attorney, Agent, or Firm*—Henry R. Lerner

[57] ABSTRACT

A glove construction is disclosed wherein a die cut trank is provided with mirror symmetrical body portions having integral upwardly extending finger stall forming portions adapted to be secured together with a fourchette therebetween. The glove is provided with reinforcing means for inhibiting the formation of runs in the body portions, said reinforcing means being applied to the finger stall forming portions adjacent the peripheral edge thereof in the crotch region of the glove, the reinforcing means being U-shaped, with the legs of the U being positioned in adjacent finger stalls and the base of the U being in the crotch between the two adjacent finger stalls. In the preferred embodiment the reinforcing means comprise merrow stitching applied to the edge of the finger stall forming portions in the U-shaped form. In another embodiment the reinforcing means comprise a top stitch extending in substantially parallel spaced relation with the edge of the finger stall forming portions. In accordance with another embodiment a binder is secured to the edge portion of the finger stall forming portion prior to the application of the merrow stitiching to the edge portions.

10 Claims, 5 Drawing Sheets

10
12"
12'
13
14
14'
14"
14a'
14a"
14b'
14b"
14c'
14c"
14d'
14d"
15
22
24
37
3

REINFORCED GLOVE FOR INHIBITING RUNS

BACKGROUND OF THE INVENTION

This invention relates generally to gloves, and more particularly, is directed to a dress glove made from a cotton blend fabric.

Gloves made from a 100% cotton material are desirable because they are handsome, durable and because the material does not have a tendency to run. This is because such material can be processed on different types of knitting machines. However, because such material is two or three times more expensive than cotton blends, and because of the difficulty of taming very high quality cotton yarns, cotton polyester blends are generally used on circular knitting machines to manufacture the material for dress gloves. There is, however, a great tendency for runs to be formed in fabric made on circular knitting machines, thereby creating serious problems when said fabric is used for making gloves. Such runs can be caused by the needle breaking a thread during sewing of the same and/or additional tensions and pressures imposed on the finished glove, particularly in the weak gusset areas, finger crotch areas and thumb crotch areas which exert tension on the knitted cotton blend fabric. Such excessive stress on the finger crotch areas, finger gusset areas and thumb crotch areas can occur merely by stretching the glove over the hand of a person. With respect to the thumb-hole opening, such reinforcement occurs regardless of the type of thumb-hole opening, such as a bolton thumb, round thumb, contour thumb or the like. However, it will be appreciated that such runs in the material are due, in great measure, to the circular knitting process, and are not limited to cotton fabrics.

With a large percentage of the gloves made of cotton blends, and thus developing a propensity to develop runs, it is generally not economically feasible to make such gloves, unless this problem can be overcome, whereby the tendency for forming runs can be significantly reduced, if not completely eliminated.

OBJECTS AND SUMMARY OF THE INVENTION

Accordingly, it is an object of the present invention to provide a novel reinforced glove.

More particularly, it is an object of the present invention to provide a reinforced glove in which the finger and thumb crotch areas are reinforced against tear and run.

It is another object of the present invention to provide a reinforced glove that hinders further travel of a tear in the glove.

In accordance with an aspect of the present invention, a glove includes a body section having a main opening which receives the hand of a person and a thumb opening; a plurality of finger stalls formed integrally with the body section for receiving the fingers of the wearer, the crotch portions of the glove at the junctions of adjacent finger stalls being reinforced so as to inhibit run formation, such reinforcement being produced in accordance with the preferred embodiment by providing merrow stitching about the raw edge portion of the finger stall forming fabric portion corresponding to the crotch portions of the glove, said merrow stitched edge portion defining run inhibiting means.

In accordance with another embodiment, the reinforcement is produced by providing top stitching in parallel spaced relation with said raw edge portion of the finger stall forming fabric portion.

In accordance with yet another embodiment, there is provided a binding enveloping said raw edge portion and secured thereto while said merrow stitching or top stitching is applied.

In accordance with yet another embodiment, the reinforcement is produced by heat sealing or fusing said raw edge fabric portions.

The above and other objects, features and advantages of the present invention will become readily apparent from the following detailed description thereof which is to be read in connection with the accompanying drawings.

DETAILED DESCRIPTION OF THE PREFERRED EMBODIMENTS

Figures 1, 2, 3, 4:
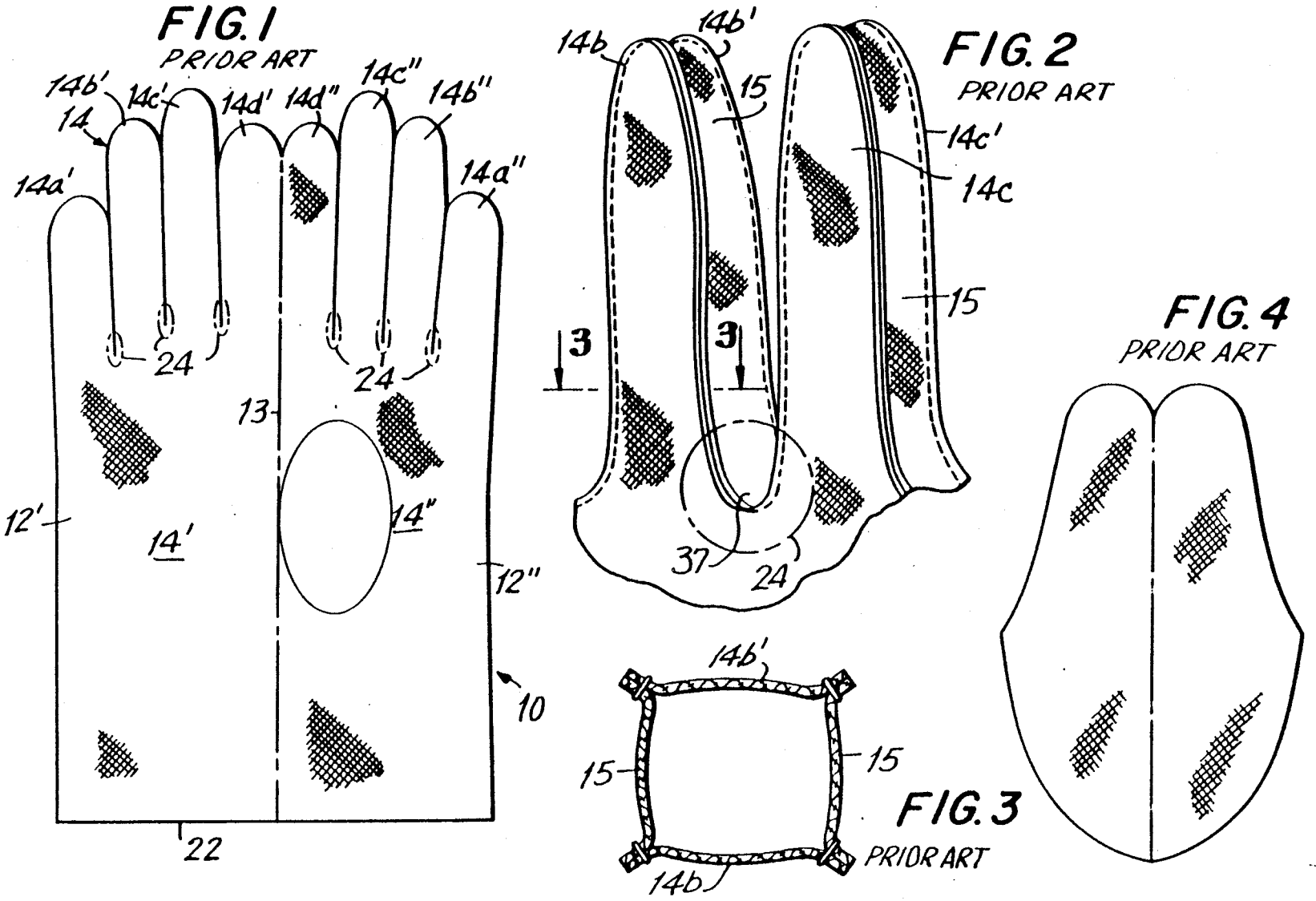
FIG. 1 PRIOR ART
FIG. 2 PRIOR ART
FIG. 3 PRIOR ART
FIG. 4 PRIOR ART
FIG. 1 is a top plan view of a cloth trank for making a glove according to the prior art.
FIG. 2 is a fragmentary perspective view showing two finger stalls in a glove made in accordance with the prior art.
FIG. 3 is a section taken along line 3—3 of FIG. 2.
FIG. 4 is a top plan view of a cloth plank for making the thumb section for attachment to the glove of FIG. 1, according to the prior art.

Referring to the drawings in detail, and initially to FIGS. 1 to 4 thereof, a cloth trank comprising essentially of a die cut fabric panel 10 is divided into two mirror symmetrical halves 12' and 12" about imaginary center dividing line 13. The left half panel 12' include a body portion 14' from which upwardly extend four finger stall forming portions 14*a*', 14*b*', and 14*d*'. Similarly right half panel 12" includes body portion 14" from which extend finger stall forming portions 14*a*", 14b'', 14c'' and 14d''. The glove is formed in conventional manner by folding panel 10 about longitudinal center line 13 and by stitching together finger stall forming portions 14a' to 14a'', 14b' to 14b'', 14c' to 14c'' and 14d' to 14d'', with an appropriate conventional fourchette 15 therebetween to form finger stalls 14a, 14b, 14c and 14d for the pinky, the ring finger, the middle finger and index finger, respectively. This is best illustrated in FIGS. 2 and 3 which depict fully assembled finger stall 14b and 14c.

A thumb opening 16 is formed in half panel 12'' to one side of center line 13, and a fabric thumb trank 18, as shown in FIG. 4, is folded about longitudinal center line 18 thereof and secured by stitching to half panel 12'' in surrounding relation to thumb opening 16 so as to provide a thumb section for receiving the thumb of the wearer of the glove. In addition, it will be appreciated that the edge 22 opposite finger stalls 14a–14d, forms a glove opening through which the hand enters the glove. It will be understood that the above described conventional glove assembly steps are made on the inner side of the glove which will therefore have to be turned inside out before using.

As discussed above, the subject gloves are made of a cotton polyester blend on a circular knitting machine. It is preferable that the material be any type of material with sufficient cotton in the blend to enable the same to be used at a fashion level as a dress glove, although the present invention is not limited to cotton blends.

However, as discussed above, when there is a tear in the glove, such tear tends to run, thereby making the glove unusable. It will further be appreciated that there is more of a tendency to create a run due to stress at a raw edge of such a glove than from an inner area spaced from an edge. Thus there is a tendency for excessive stresses to be created in the finger crotch regions of the glove, typically shown by dot-dash area 24 in FIGS. 1 and 2. The same holds true at the circumferential edge surrounding thumb opening 16.

Figure 5:
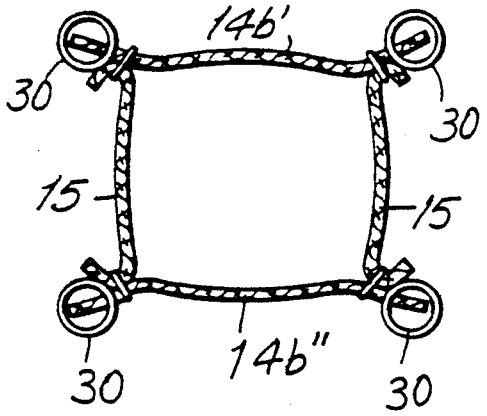
FIG. 5 is a view similar to FIG. 3 but showing the incorporation of the merrowing stitching as reinforcing means, in accordance with the preferred embodiment of the invention.
Figure 6:
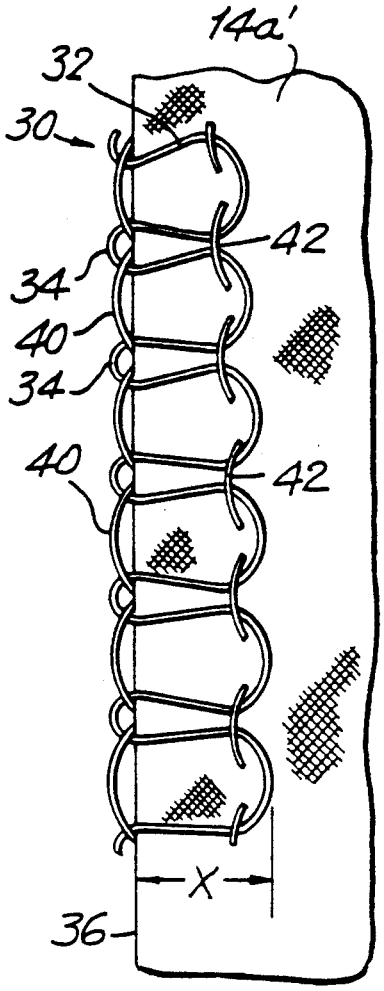
FIG. 6 is a schematic top plan view of the merrowing stitch of FIG. 5.
Figure 7:
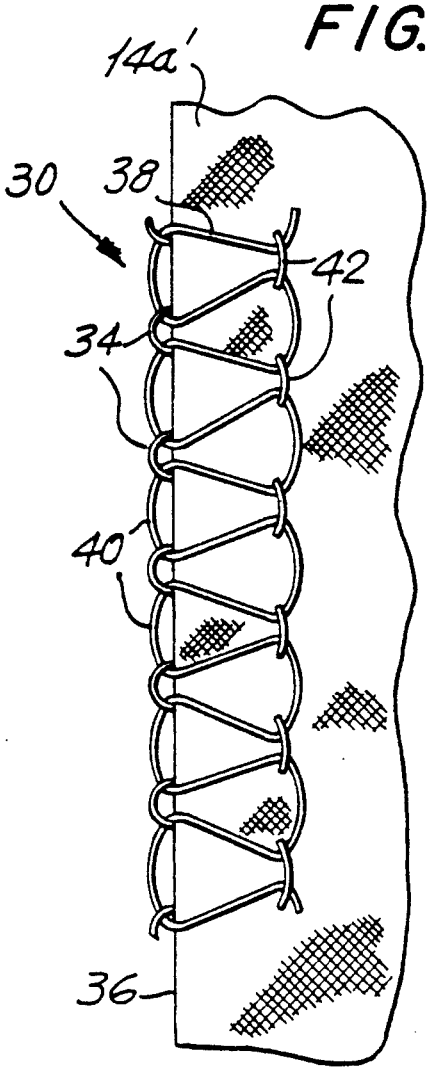
FIG. 7 is a schematic bottom plan view of the merrowing stitch of FIG. 5.
Figure 8:
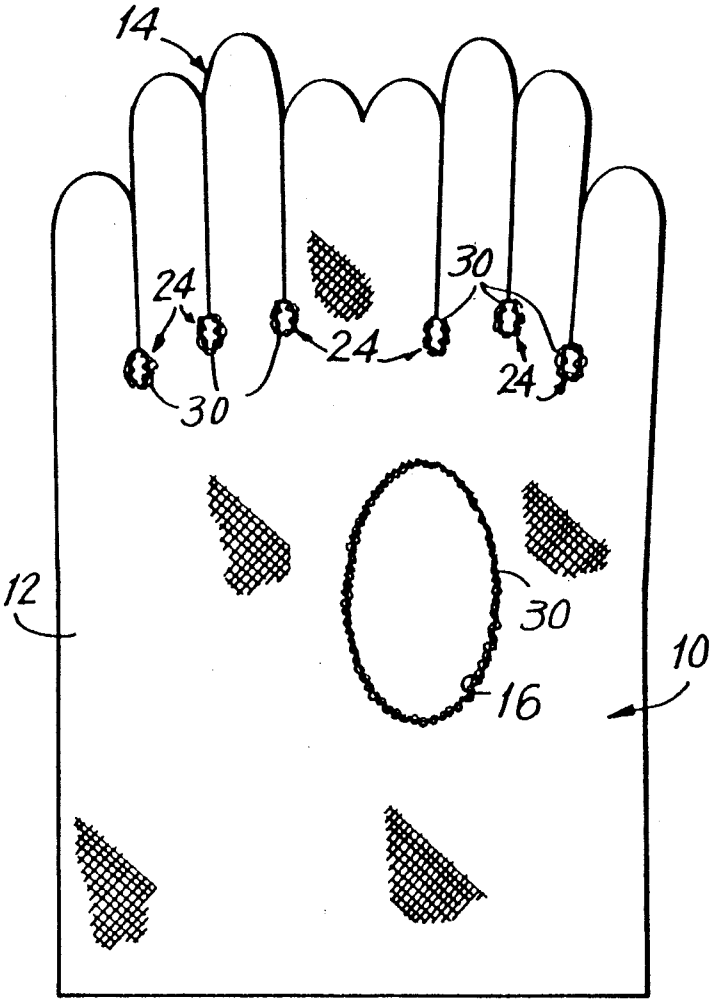
FIG. 8 is a view similar to FIG. 1 in which the reinforcing merrow stitching is shown in the crotch regions of the glove in accordance with the preferred embodiment of the invention.

In accordance with the present invention, finger crotch region 24 and the edge surrounding thumb opening 16 are reinforced so as to prevent any tear at such edge, or at least to inhibit a run if there is a tear in an edge of the fabric. According to a first aspect of the present invention, as shown in FIGS. 5 and 8, a merrowing stitch 30 is applied to the raw edges of the finger stall forming portions at the crotch region 24 thereof and around the entire thumb opening 16. Merrowing stitch 30 is a conventional over seam stitch. In effect, a merrowing stitch is a narrow overedging stitch. Specifically, as shown in FIGS. 6 and 7, on one surface of die cut finger stall forming portion 14a', a substantially sinusoidally arranged thread 32 is applied, with lower loops 34 thereof extending over the respective raw edge 36 of the fabric. A spirally arranged thread 38 is positioned on the opposite surface of the fabric with loops 40 thereof extending past edge 36 of the fabric and being interconnected with lower loops 34, as shown in FIGS. 6 and 7. The opposite ends of sinusoidally arranged thread 32 and spirally arranged thread 38 are stitched to the fabric by a stitching thread 42.

As a result, free edge 36 is reinforced with merrowing stitch 30. The inward depth X of merrowing stitch 30, as shown in FIG. 6, is approximately 1/16 of an inch, although it may extend further. In effect, merrowing stitch 30 constitutes an overedging or overlock stitch, which reinforces the free edge 36 and the fabric depth X extending therefrom. The merrow stitching 30 which is U-shaped, needs to be provided only at the crotch region between adjacent fingers and would be sufficient if the legs of the U extend for ¼ from the base 37 of the crotch, although they can certainly extend for a greater distance if desired. Merrowing stitch 30 is the preferred method of reinforcing according to the present invention.

As discussed above, there is more of a tendency to create a run with stress in edge 36 than there is from an inner portion of the material. Accordingly, merrowing stitch 30, by enclosing raw edge 36, tends to prevent any tear of the fabric at edge 36.

Figure 11:
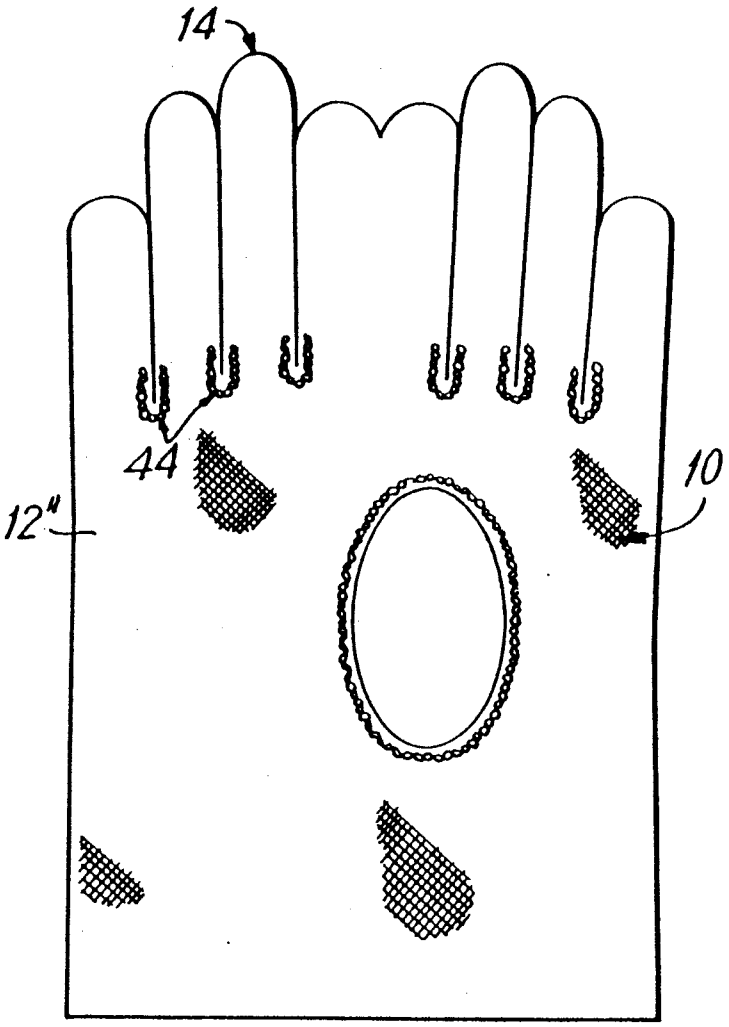
FIG. 11 is a top plan view similar to FIG. 1, in which the finger crotch regions of the glove are reinforced by the top stitch of FIGS. 9 and 10.
Figure 9:
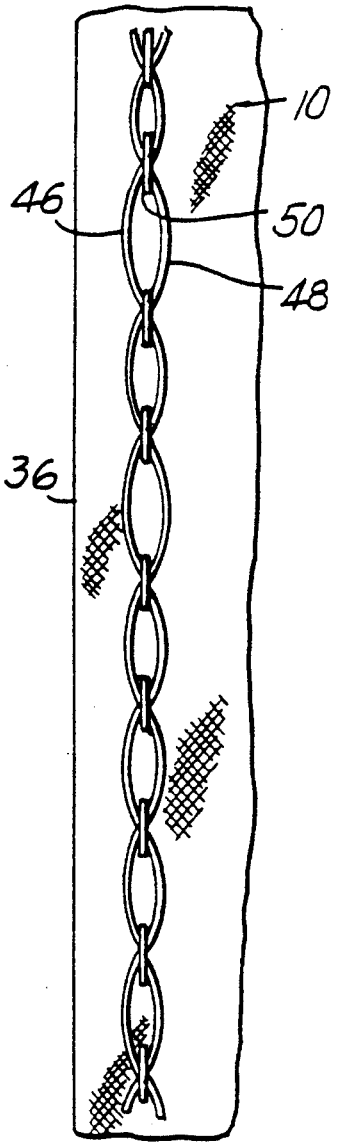
FIGS. 9 and 10 are schematic top plan and bottom plan view respectively, similarly to FIGS. 6 and 7, but showing a top stitch for reinforcement in accordance with another embodiment of the invention.
Figure 10:
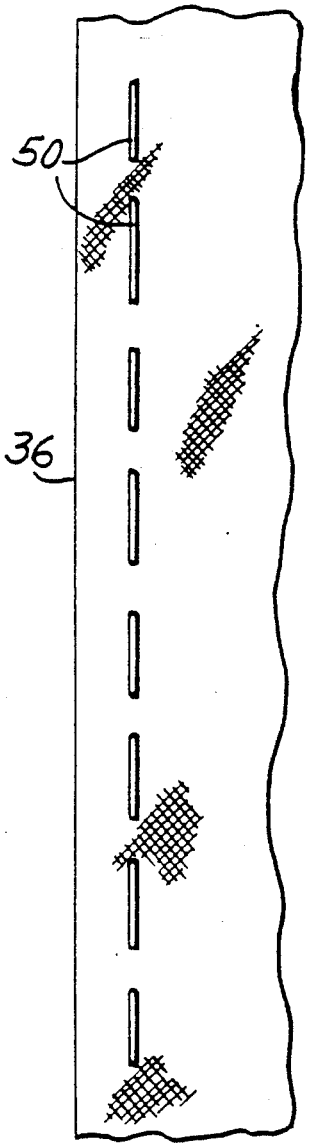

Referring now to FIGS. 9–11, in accordance with another aspect of the present invention, in place of merrowing stitch 30, a top stitch 44 is provided in each finger stall forming portion crotch area 24 and around thumb opening 16.

As shown best is FIGS. 9 and 10, top stitch 44 includes two substantially sinusoidally arranged threads 46 and 48 positioned on one surface of the fabric adjacent to and substantially parallel to free edge 36. Sinusoidally arranged threads 46 and 48 are spaced inwardly approximately 1/16 of an inch from free edge 36 and are out of phase with each other by approximately 180 degrees. A lock or running stitch 50 secures threads 46 and 48 to the fabric at the points of intersection of such threads.

Because free edge 36 is not covered, as with merrowing stitch 30, a tear may form in free edge 36 of the fabric. By use of top stitch 44, any tear at free edge 36 is prevented from running inwardly past top stitch 44. Therefore, top stitch 44 inhibits or restricts a run in the cloth.

Figure 12:
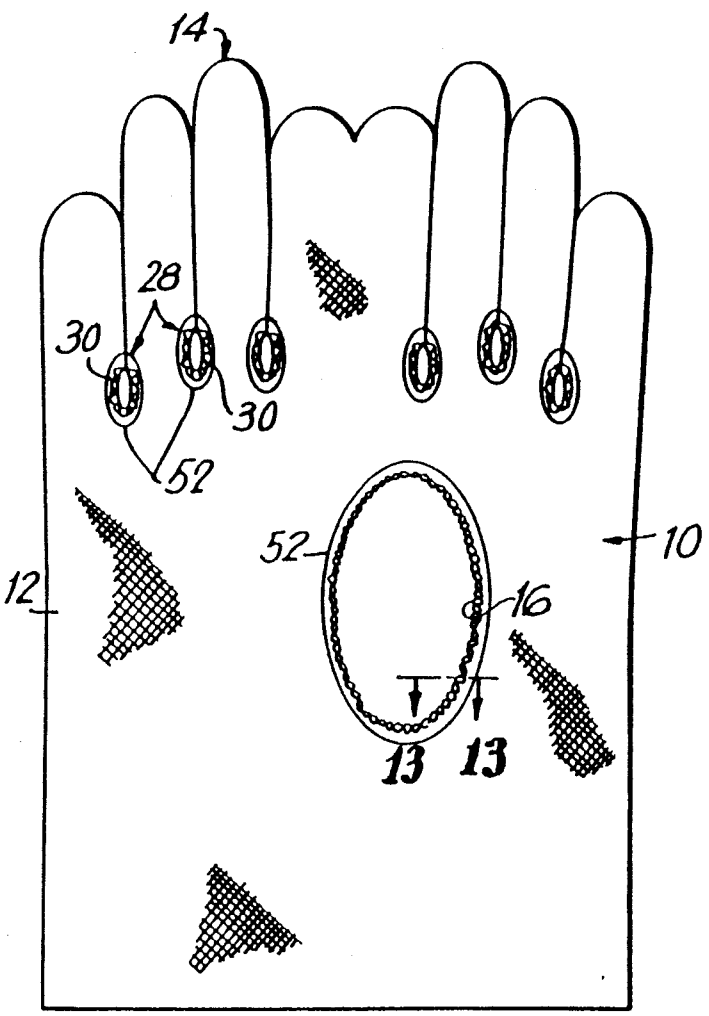
FIG. 12 is a top plan view similar to FIG. 11, but showing reinforcement at the crotch regions with a binder being used in combination with the merrow stitching.
Figure 13:
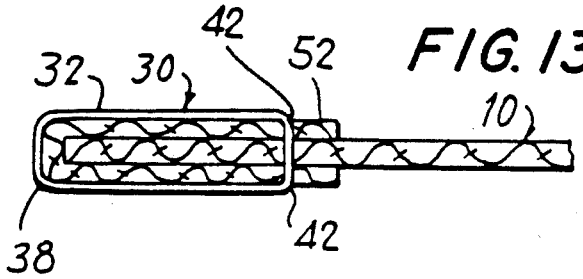
FIG. 13 is a sectional view taken across line 13—13 of FIG. 12.
Figure 15:
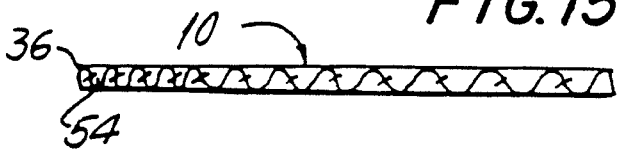
FIG. 15 is a section taken along line 15—15 of FIG. 14.

Referring now to FIGS. 12 and 13, in accordance with a third embodiment of the present invention, a binder 52 having a U-shaped, cross-sectional configuration can be provided at the raw edges of finger stall forming portions and thumb opening 16, with each binder 52 being secured thereat by the aforementioned merrowing stitch 30. Alternatively, top stitch 44 can be utilized in place of merrowing stitch 30.

As a result, raw or free edge 36 of the finger stall forming portions is not exposed so as to prevent tearing and running of the same. In effect, binder 52 functions as a protective guard. Binder cloth 52 can be made of almost any type of material, but is preferably a nylon tricot sheer material or the like.

Figure 14:
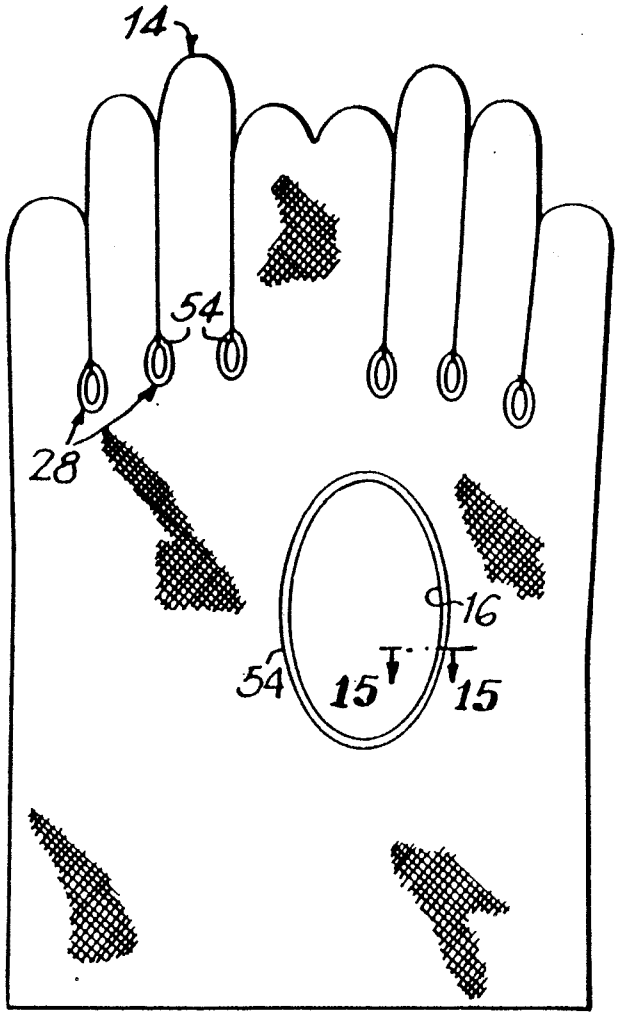
FIG. 14 is a top plan view similar to FIG. 1, wherein the crotch regions of the fingers being reinforced by fusing at the edge of the raw fabric.

Referring now to FIGS. 13 and 14, a fourth embodiment of the present invention provides reinforcement at finger crotch areas and about thumb opening 16 by fusing free edge 36 thereat. As a result, the area inwardly of free edge 36 is formed by the fused fibers into a hardened portion 54 which prevents tearing and running of the cloth thereat. Fused portion 54 can be formed by any suitable fusing method, such as the use of ultra-high frequency waves which melts the plastic or polyester portion of the fabric at free edges 36 by a small amount so as to fuse the same to the individual threads which make up the material. Alternatively, a conventional heat sealing method can be used.

In actual practice, upon completion of one of the aforementioned crotch reinforcing steps at the raw edge of the finger stall forming portions 14a' through 14d'', namely, (a) applying the merrowing stitch, (b) applying the top stitch, or (c) fusing the free edge, the conventional fourchette 15, that is, a side wall, is secured to the finger stall forming portions, as is conventional, and also as shown in FIGS. 2 and 3. Fourchette 15 is stitched to the outer periphery of finger stall forming portions 14a' through 14d' and 14a'' through 14d'' by any conventional stitching. Thereafter, cloth trank 10 is folded about center line 13 so as to secure half panel 12' to half panel 12'' together along with fourchette 15, and with the side edges of cloth trank 10 being secured together. Thumb trank 18 is then secured to cloth trank 10 about thumb opening 16 so as to complete formation of the glove, whereupon the glove is turned inside out after trimming the different sewing threads.

It will therefore be appreciated that reinforcement of the finger crotch areas and thumb opening 16 is accomplished either by a merrowing or overedging stitch 30 which captures free edge 36, or by leaving free edge 36 alone and having a top stitch 44 adjacent free edge 36. As a result of such reinforcement, running of the cloth is prevented due to, for example, broken yarns, unusual pressures placed on certain areas of the glove by attempting to fit a large hand into a small sized glove. It will be appreciated that such stress can even occur during production when the finger stall 16 is separated in order to insert the fourchette, or on the thumb-hole 20 when inserting and sewing thumb trank 22 therein, or even when turning the glove inside out or pressing the glove. Accordingly, by such reinforcement, elimination of runs in the major areas where there is a tendency for such runs, would be prevented. While the thumb illustrated herein is a round thumb, it will be understood that a bolton thumb can be used which is similarly reinforced to reduce the run forming tendency.

Having described specific preferred embodiments of the invention with reference to the accompanying drawings, it will be appreciated that the present invention is not limited to those precise embodiments, and that various changes and modifications can be effected therein by one of ordinary skill in the art without departing from the scope or spirit of the invention as defined by the appended claims.

What is claimed is:

1. In a glove construction of the type wherein a die cut trank is provided with mirror symmetrical body portions having integral upwardly extending finger stall forming portions adapted to be secured together with a fourchette therebetween, the improvement comprising reinforcing means for inhibiting the formation of runs in said body portions, said reinforcing means being applied to said finger stall forming portions adjacent the peripheral edge thereof in the crotch region of the glove for an extent which is less than the entire peripheral contour of the stall forming portion said reinforcing means being U-shaped with the legs of the U being positioned in adjacent finger stalls and the base of the U being in the crotch between said two adjacent finger stalls.

2. A glove construction in accordance with claim 1, wherein said reinforcing means comprise overedge stitching applied to the edge of said finger stall forming portions in said U-shaped form.

3. A glove construction in accordance with claim 1, wherein said reinforcing means comprise a top stitch extending in substantially parallel spaced relation with the edge of said finger stall forming portions.

4. A glove construction in accordance with claim 1, wherein the die cut trank is provided with an opening for the thumb, and said reinforcing means are applied to the contour of said opening.

5. A glove construction in accordance with claim 1, wherein a binder is secured to the edge portion of the finger stall forming portion prior to the application of the merrow stitching to said edge portions.

6. A glove construction in accordance with claim 1, wherein the depth of said reinforcing means is approximately 1/16 of an inch.

7. A glove construction in accordance with claim 2, wherein the leg of the U extends for approximately ½".

8. A glove construction in accordance with claim 1, wherein said reinforcing means comprise fused edge portions on said finger stall forming portions.

9. A glove construction in accordance with claim 2, wherein a binder is secured to the edge portion of the finger stall forming portion prior to the application of the merrow stitching to said edge portions.

10. A glove construction in accordance with claim 3, wherein a binder is secured to the edge portion of the finger stall forming portion prior to the application of the merrow stitching to said edge portions.

* * * * *